US006595145B1

(12) United States Patent
Lietz

(10) Patent No.: US 6,595,145 B1
(45) Date of Patent: Jul. 22, 2003

(54) ADJUSTABLE SHELVING SYSTEM

(76) Inventor: Richard A. Lietz, 1755 Colgate Dr., Colorado Springs, CO (US) 80918

( * ) Notice: Subject to any disclaimer, the term of this patent is extended or adjusted under 35 U.S.C. 154(b) by 0 days.

(21) Appl. No.: 10/013,555

(22) Filed: Dec. 11, 2001

(51) Int. Cl.[7] ..... A47B 5/00
(52) U.S. Cl. ..... 108/149; 108/106; 211/117
(58) Field of Search ..... 108/149, 106, 108/107, 110; 248/247, 248, 300, 317, 328; 211/117, 118

(56) References Cited

U.S. PATENT DOCUMENTS

| | | | | | |
|---|---|---|---|---|---|
| 889,844 | A | * | 6/1908 | Beach | 108/149 |
| 1,816,705 | A | * | 7/1931 | Traylor et al. | 108/1 |
| 2,556,105 | A | * | 6/1951 | Rhett | 108/106 |
| 3,799,072 | A | * | 3/1974 | Slaboden | 108/107 |
| 4,061,092 | A | * | 12/1977 | Jacobsen et al. | 108/149 |
| 4,187,787 | A | | 2/1980 | Nakatsu | |
| 4,295,432 | A | | 10/1981 | Hulke | |
| 4,825,504 | A | * | 5/1989 | Camilleri | 16/108 |
| 5,542,530 | A | | 8/1996 | Freelander | |
| 6,116,164 | A | | 9/2000 | Justen, Jr. | |

FOREIGN PATENT DOCUMENTS

| | | | |
|---|---|---|---|
| FR | 608482 | * | 4/1926 |
| GB | 222248 | * | 4/1924 |

* cited by examiner

*Primary Examiner*—Lanna Mai
*Assistant Examiner*—Jerry A. Anderson
(74) *Attorney, Agent, or Firm*—Sturm & Fix LLP

(57) ABSTRACT

The present invention is a adjustable shelving system including a freestanding arch-like framework having a pair of horizontally spaced vertical columns interconnected by top and bottom horizontal beams. Two pairs of flexible connectors, such as link chains, are suspended from the top beam, each respective pair of connectors being disposed interior to and between the columns. The flexible connectors are attached to and support vertically adjustable shelves. In one embodiment, openings are formed through the adjustable shelves to receive the flexible connectors and a shelf support bar extends between the connectors in each pair to contact the bottom surface of the shelf and support it. In another embodiment, eye screws extend out from the side edges of the shelves to receive the shelf support bar, or the eye screws are supported by the flexible connectors. A bottom stationary shelf must be used to provide for attachment and tensioning of the flexible connectors.

13 Claims, 2 Drawing Sheets

ADJUSTABLE SHELVING SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of shelving systems, and more particularly to an adjustable shelving system.

2. Description of Related Art

As can be seen by reference to the following U.S. Pat. Nos. 4,187,787; 4,295,432; 5,542,530 and 6,116,164, the prior art is replete with myriad and diverse shelving devices.

While all of the aforementioned prior art constructions are more than adequate for the basic purpose and function for which they have been specifically designed, they are uniformly deficient with respect to their failure to provide a simple, efficient, and practical adjustable shelving system. These other systems are not self-supporting, requiring a wall or ceiling, making them unattractive in appearance. Also, the other designs are only as strong as the two screws that ultimately bear the entire load.

As a consequence of the foregoing situation, there has existed a longstanding need for a new and improved adjustable shelving system and the provision of such a construction is a stated objective of the present invention.

BRIEF SUMMARY OF THE INVENTION

Briefly stated, the present invention provides an adjustable shelving system including a freestanding arch-like framework having three vertical columns on each side interconnected by top and bottom horizontal beams. Two pairs of flexible connectors, such as link chains, are suspended from the top beam, each respective pair of connectors being disposed interior to the columns and specifically to be seen between each of the side columns (from side view). This placement is crucial to the attractiveness of the unit. The flexible connectors are attached to and support vertically adjustable shelves. In one embodiment, openings are formed through the adjustable shelves to receive the flexible connectors and a shelf support bar extends between the connectors in each pair to contact the bottom surface of the shelf and support it. In another embodiment, eye screws extend out from the side edges of the shelves to receive the shelf support bar, or the eye screws are supported by the flexible connectors. A bottom stationary shelf must be used to provide unit stability and for attachment and tensioning of the flexible connectors.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
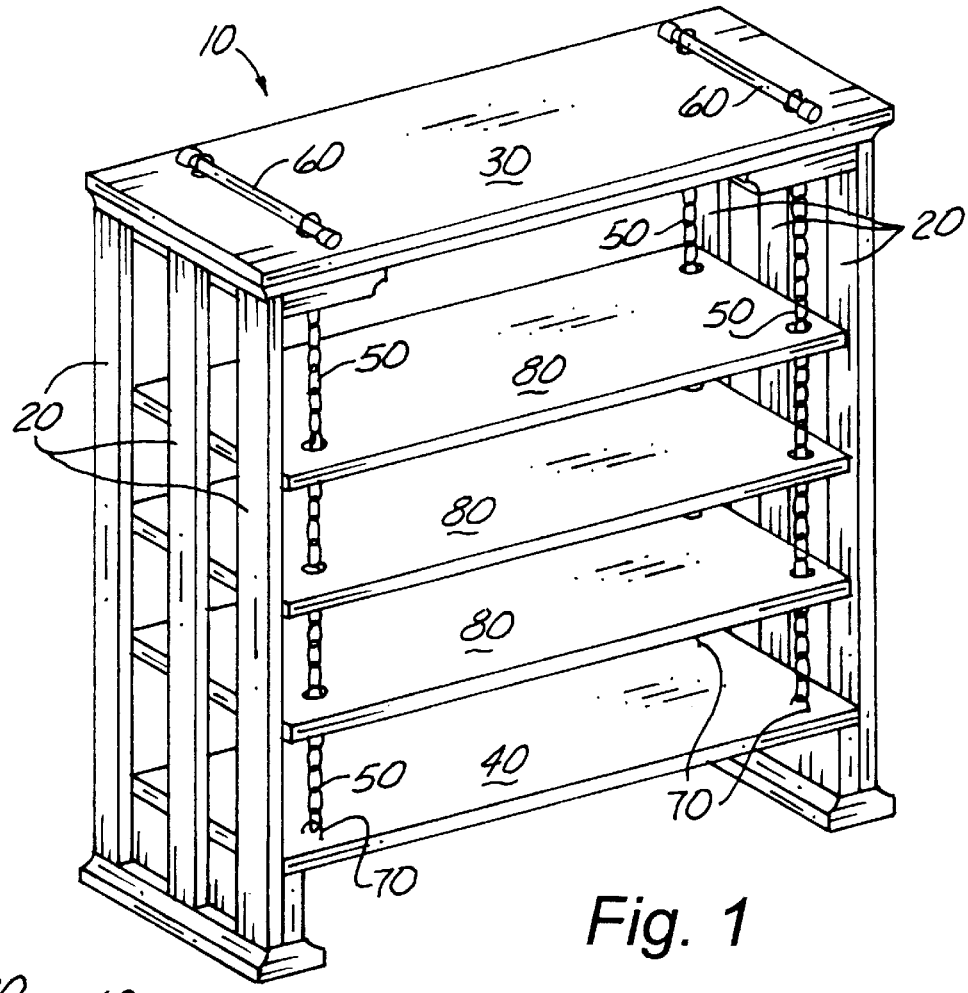
FIG. 1 is a perspective view of one embodiment of the present invention.
Figure 1A:
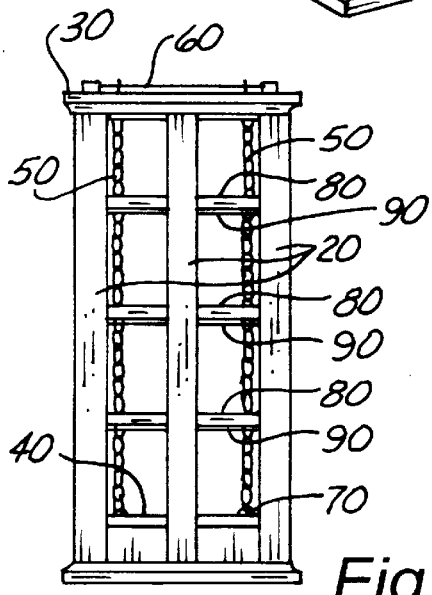
FIG. 1A is a side elevational view thereof.
Figure 2:
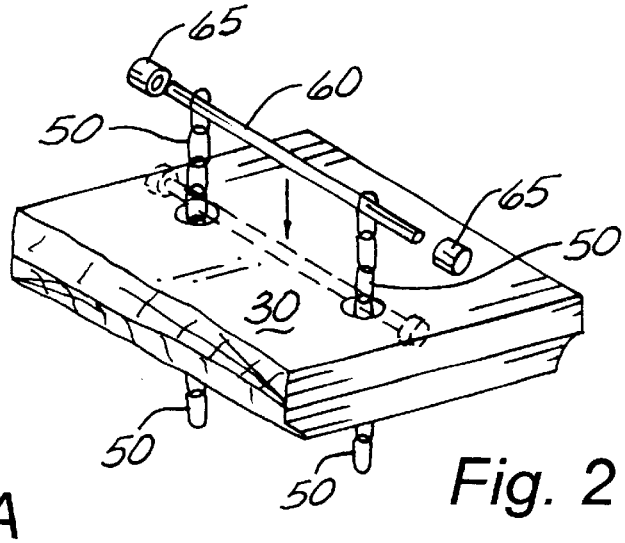
FIG. 2 is a partial perspective view showing one of the suspension bars used to secure a pair of link chain connectors to the top beam of the framework.
Figure 4:
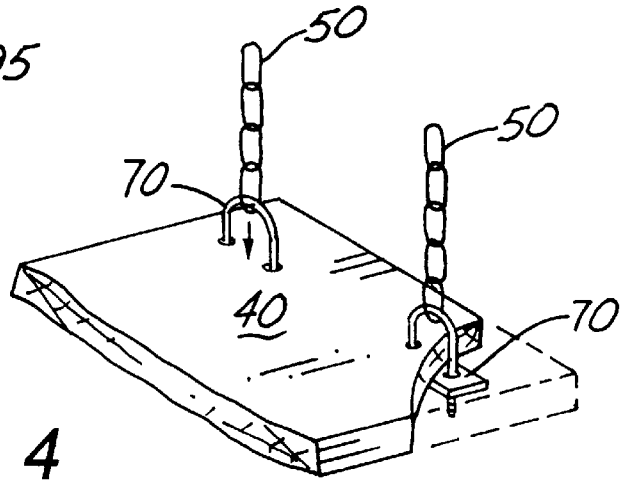
FIG. 4 is a partial perspective view showing the interconnection of the stationary bottom shelf with the flexible connectors using tensioning U-bolts.

As can be seen by reference to the drawings, and in particularly to FIG. 1, the adjustable shelving system that forms the basis of the present invention is designated generally by the reference number 10. The adjustable shelving system includes an arch-like framework formed of vertical columns 20 interconnected by a horizontal top beam 30. Also, the shelving system 10 shown in FIG. 1 includes a stationary bottom shelf 40 that provides a rectangular framework and a bottom anchor for the flexible connectors. Two pairs of link chain flexible connectors 50 are suspended from the top beam 30 by extension bars 60 that are received through links of the chain 50 extending through openings in the top beam 30. As best shown in FIG. 2, end caps 65 are sized larger than the link and frictionally engage the ends of the suspension bar 60 to prevent it from inadvertently moving out on engagement with the chain 50. FIG. 4 shows the connection of the chain 50 to the stationary bottom shelf 40 by U-bolts 70 which can be tightened to secure and tension the chain 50.

Figure 3:
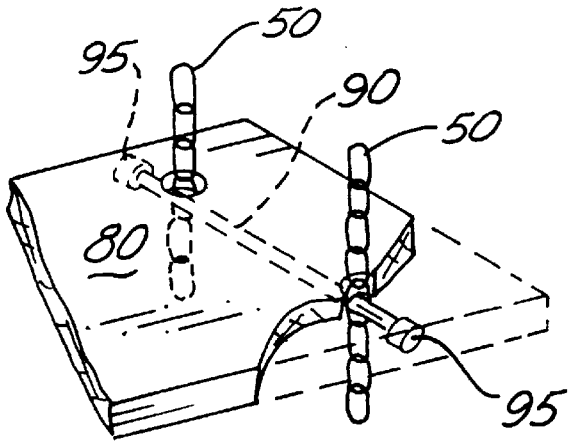
FIG. 3 is a partial perspective view showing the connection of the adjustable shelf to the flexible link chain connectors and the shelf support bar.

FIGS. 1 and 3 illustrate one embodiment of the invention where openings are formed through adjustable shelves 80 to receive the chain 50. A shelf support bar 90 extends through openings in the line chain 50 to contact the bottom surface of the adjustable shelf 80 and support it. Enlarged end caps 95 frictionally engage the ends of the shelf support bars 90.

Figure 5:
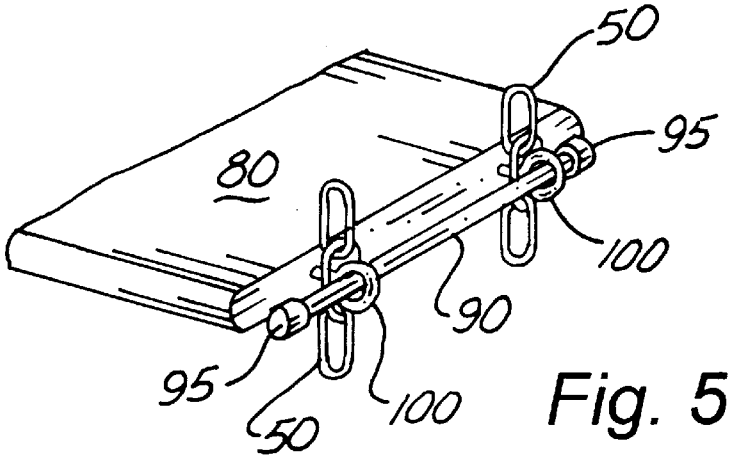
FIG. 5 is a partial perspective view showing an alternate connection of the adjustable shelf to the flexible link chain connectors and the shelf support bar.

FIG. 5 shows an alternate embodiment where eye screws 100 extend out from the side edges of the adjustable shelf 80 to receive the chain 50 and the shelf support bar 90. It is understood that the support bar 90 could alternatively extend through openings in the link chain 50.

The embodiment shown in FIGS. 1 and 3 has the chain 50 running through each adjustable shelf 80 and the U-bolts 70 under the bottom stationary shelf 40 need to be unscrewed in order to add more adjustable shelves 80. The embodiment shown in FIG. 5 uses eye screws 100 on the sides of the shelves 80 in order to attach to the chain 50. The shelves 80 have no holes in them and no disassembly is required to add more shelves 80. The first variation is more attractive and would probably be favored for furniture applications; the second might be preferred for commercial applications such as inventory stocking, or in a restaurant pantry.

Both functionally and as a new design, this system can replace any shelf and can be used for furniture, for example bookcases, media storage, coffee and end tables, china cabinets, curios, displays, armoires, built-in library, stereo cabinet, etc. Also, the system can be used for storage, such as in closets, offices, garages, laundries, baths, etc. This system replaces the unattractive holes in the sides of normal adjustable shelf systems with attractive chain that is visible between the mission-style side columns. The units require no back piece, saving in manufacturing costs and providing a unique and attractive design that blends with the wall behind the unit or provides viewing from both sided if used as a room divider or display. The simple shelf design allows additional shelves to be added where most current shelf designs are more difficult to replicate at home and additional shelves are rarely offered for sale. Variation in shelf spacing is accomplished by choosing alternate chain links. Also, this system provides a "shock absorber" in that there is a slight "give" if the shelf is bumped into.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A adjustable shelving system, comprising:

a first vertical column;

a second vertical column horizontally spaced from the first column;

a horizontal beam attached to and interconnecting the first and second columns;

a first pair of flexible connectors attached to and suspended from the beam adjacent to and interior of the first column;

a second pair of flexible connectors attached to and suspended from the beam adjacent to and interior of the second column;

an adjustable shelf having a top surface, a bottom surface, a first side edge, a second side edge, a front edge and a rear edge;

a first pair of openings adjacent to the first side edge of the adjustable shelf and aligned in registry with the first pair of connectors, and a second pair of openings adjacent to the second side edge of the adjustable shelf and aligned in registry with the second pair of connectors;

a first horizontal shelf support bar disposed to interconnect the first pair of connectors, and disposed to contact and support the adjustable shelf; and a second horizontal shelf support bar disposed to interconnect the second pair of connectors, and disposed to contact and support the adjustable shelf;

wherein the horizontal beam is a stationary top shelf having a top surface and a bottom surface, and wherein the first and second pair of flexible connectors extend through openings in the stationary top shelf and are interconnected by and suspended from horizontal suspension bars disposed in contact with the top surface of the stationary top shelf.

2. The adjustable shelving of claim 1 wherein the first and second vertical columns each include three horizontally spaced support members separated by vertical gaps.

3. The adjustable shelving of claim 2 wherein the first and second pair of flexible connectors are positioned interior of and between the horizontally spaced support members and aligned with the vertical gaps.

4. The adjustable shelving system of claim 1, wherein the first and second pair of flexible connectors comprise chains having a plurality of open links, the open links being sized to receive one of the first and second shelf support bars, and the horizontal suspension bars.

5. The adjustable shelving of claim 1, wherein the first and second pair of openings in the adjustable shelf are formed through the adjustable shelf interior of the first and second ends, respectively.

6. The adjustable shelving of claim 5, wherein the first and second pair of flexible connectors comprise chains having a plurality of open links, the open links being sized to receive one of the first and second shelf support bars, and the horizontal suspension bars.

7. The adjustable shelving of claim 1, wherein a plurality of adjustable shelves are supported by the first and second pair of flexible connectors and are vertically spaced below the horizontal beam.

8. The adjustable shelving of claim 1, further including enlarged end caps disposed to frictionally engage ends of the first and second shelf support bars.

9. The adjustable shelving of claim 1, wherein the first and second pair of openings adjacent the adjustable shelf are in eye screws attached to and extending out from the first and second side edges, respectively, of the adjustable shelf.

10. The adjustable shelving of claim 9, wherein the first and second pair of flexible connectors comprise chains having a plurality of open links, the open links being sized to receive one of the first and second shelf support bars, and the horizontal suspension bars.

11. The adjustable shelving of claim 1, further including a stationary bottom shelf attached to and interconnecting the first and second vertical columns and disposed below the adjustable shelf.

12. The adjustable shelving of claim 11, wherein the first and second pair of flexible connectors are releasably secured to the stationary bottom shelf.

13. The adjustable shelving of claim 12, wherein the first and second pair of flexible connectors are secured to the stationary bottom shelf by U-bolts disposed to interconnect the stationary bottom shelf and the first and second pair of flexible connectors.

* * * * *